US005343859A

United States Patent [19]

Kikut

[11] Patent Number: 5,343,859

[45] Date of Patent: Sep. 6, 1994

[54] PASSENGER OXYGEN MASK HAVING INTERNAL FLOW CONFIRMATION BALLOON

[75] Inventor: Aksi Kikut, Manhattan Beach, Calif.

[73] Assignee: Puritan-Bennett Corporation, Overland Park, Kans.

[21] Appl. No.: 77,604

[22] Filed: Jun. 17, 1993

[51] Int. Cl.[5] ..... A62B 7/00

[52] U.S. Cl. ..... 128/205.13; 128/205.15; 128/205.14

[58] Field of Search ..... 128/201.25, 201.29, 128/202.22, 205.15, 205.16, 205.13, 205.14

[56] References Cited

U.S. PATENT DOCUMENTS

| | | | |
|---|---|---|---|
| 654,372 | 7/1900 | West | 116/270 |
| 2,228,502 | 1/1941 | Boothby | 128/201.19 |
| 2,241,535 | 5/1941 | Boothby et al. | 128/205.17 |
| 2,505,118 | 4/1950 | Holmes | 116/271 |
| 2,618,977 | 11/1952 | Hottenroth | 73/715 |
| 2,652,830 | 9/1953 | Koza et al. | 128/205.17 |
| 2,677,371 | 5/1954 | Serra | 128/205.12 |
| 2,944,547 | 7/1960 | Ziherl et al. | 128/203.21 |
| 3,097,642 | 7/1963 | Russell | 128/205.17 |
| 3,136,312 | 6/1964 | Gattone | 128/205.13 |
| 3,208,449 | 9/1965 | Bartlett, Jr. | 128/204.28 |
| 3,241,514 | 3/1966 | Grimland | 116/270 |
| 3,291,121 | 12/1966 | Vizneau | 128/205.15 |
| 3,467,092 | 9/1969 | Bird et al. | 128/205.15 |
| 3,467,094 | 9/1969 | Goodman | 128/205.15 |
| 3,473,529 | 10/1969 | Wallace | 128/204.19 |
| 3,540,443 | 11/1970 | Huddy | 128/205.17 |
| 3,604,416 | 9/1971 | Petrahal | 128/201.25 |
| 3,731,691 | 5/1973 | Chen | 128/207.15 |
| 3,773,045 | 11/1973 | Boba | 128/205.17 |
| 3,810,474 | 5/1974 | Cross | 128/207.15 |
| 3,905,361 | 9/1975 | Hewson et al. | 128/202.16 |
| 4,014,326 | 3/1977 | Müller | 128/205.15 |
| 4,098,271 | 7/1978 | Maddock | 128/202.22 |
| 4,409,977 | 10/1983 | Bisera et al. | 128/205.15 |
| 4,559,939 | 12/1985 | Levine et al. | 128/201.25 |
| 4,766,893 | 8/1988 | Drews | 128/201.29 |
| 4,821,712 | 4/1989 | Gossett | 128/205.15 |
| 5,115,804 | 5/1992 | Brookman | 128/201.25 |

FOREIGN PATENT DOCUMENTS 828362 2/1960 United Kingdom .

*Primary Examiner*—Edgar S. Burr
*Assistant Examiner*—Aaron J. Lewis
*Attorney, Agent, or Firm*—Hovey, Williams, Timmons & Collins

[57] ABSTRACT

Oxygen dispensing apparatus (10) is provided which includes a relatively large, primary oxygen chamber (12) operably coupled to a cup-like passenger mask (14), along with a flexible inflatable apertured indicator element (18) positioned within the confines of the chamber (12) and operably coupled with the oxygen supply conduit (16) for the apparatus (10). In use, oxygen flows through the conduit (36) and inflates the element (18) to give a visual indication of proper oxygen flow to the user; the oxygen then flows from the aperture (42) of the element (18) into the primary chamber (12), where it is available for consumption by the passenger. Placement of the element (18) within the confines of primary chamber (12) assures that oxygen flow is maintained to the passenger, even in the event of failure of the indicator element (18).

10 Claims, 1 Drawing Sheet

PASSENGER OXYGEN MASK HAVING INTERNAL FLOW CONFIRMATION BALLOON

BACKGROUND OF THE INVENTION

1. Field of the Invention

The present invention is broadly concerned with an improved oxygen dispensing apparatus of the type typically found in aircraft for supplying oxygen to passengers under emergency, reduced atmospheric conditions. More particularly, it is concerned with such apparatus which includes a relatively small, brightly colored flexible inflatable indicator element, preferably positioned within the confines of the primary oxygen supply chamber or bag, so that airline personnel can readily determine whether all passengers are receiving oxygen during an emergency.

2. Description of the Prior Art

A universal feature of passenger aircraft is the provision of stowed, overhead oxygen masks in the passenger compartment which are designed to drop within easy reach of the passengers in the event of a rapid depressurization of the aircraft. The passengers don these masks and are supplied with oxygen for a period permitting repressurization of the aircraft or safe landing.

It has been known in the past to provide various indicator devices associated with passenger oxygen masks, so that aircraft personnel can visually ascertain and confirm that all passengers are receiving oxygen. These devices have included in-line, rigid synthetic resin tubular bodies having an internal, shiftable flow indicator which moves to confirm oxygen flow. In addition, U.S. Pat. No. 4,098,271 describes an inflatable flow indicator device formed from peripherally sealed sheets as a subsection of the primary oxygen accumulation bag. The device described in this patent is deficient in that if a tear or aperture is present in the indicator section, oxygen flow to the passenger is lost.

There is accordingly a need in the art for an improved passenger oxygen mask having an inflatable, readily detectable indicator, but which will nevertheless supply oxygen to the user even in the event that the indicator structure becomes torn or otherwise unusable.

SUMMARY OF THE INVENTION

The present invention overcomes the problems outlined above, and provides an oxygen dispensing apparatus equipped with an inflatable indicator element preferably situated within the confines of the primary chamber or bag of the mask assembly, so that even if the indicator element is damaged, the user will still receive oxygen.

Broadly speaking, the preferred oxygen dispensing apparatus of the invention includes means defining a relatively large, primary oxygen supply chamber which includes an oxygen inlet and an oxygen outlet. This primary chamber is advantageously formed as a relatively large, elongated, flexible bag with the inlet and outlet being on opposed ends thereof. A mask or other conventional delivery mean is coupled to the outlet of the primary supply chamber, for delivery of oxygen to a user. An elongated, tubular oxygen supply conduit is operably coupled to the oxygen inlet for conveying oxygen to the primary chamber.

The dispensing apparatus also includes a relatively small, apertured, inflatable indicator element which is advantageously positioned within the confines of the primary chamber and operably coupled with the supply conduit. In this manner, oxygen flows from the conduit into and through the element for inflation thereof, and thereafter flows out of the element aperture into the interior of the primary chamber. In particularly preferred forms, the end of the supply conduit is located within the primary chamber, and the element is secured to the conduit at this point; thus, in this form the indicator element is positioned wholly within the confines of the primary chamber.

The preferred indicator element is in the form of an integral, one-piece, monolithic, molded tubular body. Normally, the primary chamber should have an inflated volume at least ten times greater than the inflated volume of the indicator element.

DETAILED DESCRIPTION OF THE PREFERRED EMBODIMENTS

Figures 1, 2, 3, 4, 5:
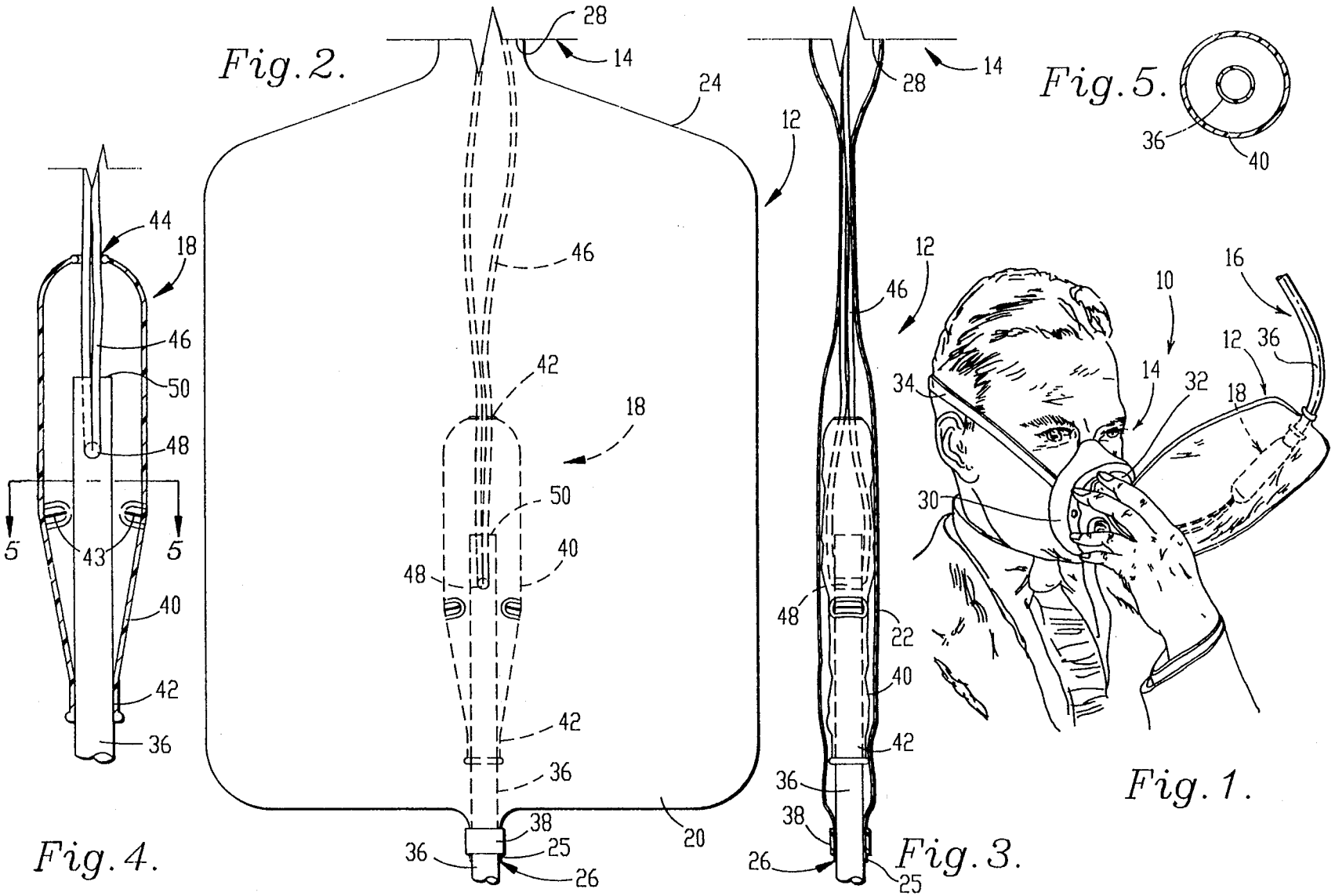
FIG. 1 is an elevational view of the oxygen dispensing apparatus of the invention, shown in use by a passenger and with the internal indicator element inflated to confirm oxygen flow to the passenger.
FIG. 2 is an elevational view of the primary chamber bag, with the preferred internal indicator element being depicted in phantom.
FIG. 3 is a side sectional view of the assembly depicted in FIG. 2, showing the internal indicator element in its collapsed position.
FIG. 4 is an enlarged, fragmentary vertical sectional view illustrating the preferred internal indicator element in an inflated condition.
FIG. 5 is a sectional view taken along line 5—5 of FIG. 4.

Turning now to the drawings, and particularly FIGS. 1–2, oxygen dispensing apparatus 10 is illustrated. The apparatus 10 includes a relatively large, flexible, primary oxygen supply chamber 12, an oxygen delivery mask 14 coupled to the upper end of chamber 12, a flexible tubular oxygen conduit 16 coupled to the opposed end of the chamber 12, and an inflatable indicator element 18 located within the confines of chamber 12.

In more detail, primary chamber 12 is made up of a pair of flexible, somewhat rectangular, transparent sheets 20, 22 which are conventionally sealed adjacent their peripheries as at 24 while presenting a tubular nipple 25 defining a lowermost oxygen inlet opening 26 and an opposed oxygen outlet opening 28. The chamber 12 when inflated presents a relatively large volume as will be apparent from a study of FIGS. 1 and 2.

Mask 14 is in the form of a cup-like body 30 presenting an apertured inlet face 32 equipped with the usual oxygen and air inhalation valves, and an exhalation valve. An adjustable elastic strap 34 is connected to the sides of body 30 to allow attachment of the apparatus 10 to the head of a passenger. It will be understood in this respect that the mask 14 is itself entirely conventional, and that the end of chamber 12 defining outlet opening 28 is secured to and in communication with the oxygen inhalation valve thereof.

Oxygen conduit 16 is preferably in the form of an elongated, transparent tube 36 extending through inlet opening 26 and into the confines of primary chamber 12. The conduit 16 may be of the thin, lightweight type having internal ribs, as described in co-pending application Ser. No. 07/907,407, filed Jul. 1, 1992, which is incorporated by reference herein. A synthetic resin sealing ring 38 is employed to effect a sealing connection between nipple 25 and tube 36. The opposite end of tube 36 is connected to an oxygen supply (not shown) in the usual fashion.

Indicator element 18 is in the form of an integral, one-piece, monolithic, molded tubular body 40 presenting a constricted tubular end 42 as well as an oxygen outlet aperture 44 adjacent the opposite end thereof. Preferably, the body 40 is formed of silicon rubber and is produced by a conventional compression molding process, and has an essentially equal thickness about the circumference thereof. As best seen in FIGS. 3 and 4, tube 36 extends through constricted tubular end 42 of the body 40, well into the interior of the latter. A seal is effected between constricted tubular end 42 and the sidewall tube 36, by welding or other conventional means. It will also be seen that the element 18 includes a pair of short, spaced apart lines of weakness 43 therein. Under normal inflation pressures, these lines of weakness do not come into play, in the event of excess inflation pressure, however, these open to bleed oxygen directly into the primary chamber 12.

In order to strengthen the overall apparatus 10, a reinforcing string 46 is looped around the oxygen inlet valve of mask 14 and connected to the end of tube 36 within element 18. Specifically, the string 46 is threaded through a metallic tubular stay 48 positioned transversely across tube 36 close to the butt end 50 thereof within body 40. The two adjacent stretches of the string 46 then pass through aperture 42 as shown for loop connection to the mask 14.

As will be readily appreciated from a study of FIGS. 2–3, the relative inflated volumes of the body 40 and chamber 12 are greatly different, i.e., the chamber 12 should have an inflated volume at least ten times greater than that of the body 14 therein. Likewise, in order to facilitate ready observation of the element 18 in use, it is preferred that the body 40 be brightly colored.

In the use of apparatus 10 in the event of an aircraft depressurization, the mask 14 falls into easy reach of the passenger who immediately dons the mask as shown, with the cup-like body 30 covering both the nose and mouth of the passenger. The apparatus 10 is designed so that immediately upon descent of the mask, oxygen begins flowing through the tube 36, so that there is no delay in providing supplemental oxygen to the passenger. In any event, provision of the indicator element 18 allows the aircraft personnel to readily confirm that the passenger is receiving oxygen. Specifically, upon initiation of oxygen flow through tube 36, the brightly colored tubular body 40 is inflated and can easily be seen. However, the oxygen also flows out of the opening 42 and into primary chamber 12, so that the oxygen may ultimately be consumed by the passenger through normal breathing. Of course, the indicator element 18 remains in an inflated condition throughout the entire time that oxygen is being delivered to the passenger.

It will also be appreciated that in the event of a failure of the body 40 through a tear or other mishap, the passenger still is given all of the oxygen he would otherwise receive. Likewise, if excess oxygen is delivered which could burst element 18, the lines of weakness 43 split to relieve the pressure while maintaining the overall element 18 intact. This is to be contrasted with the mask described in U.S. Pat. No. 4,098,271, wherein such failure of the indicator chamber would lead to cessation of oxygen flow to the passenger.

I claim:

1. Oxygen dispensing apparatus, comprising:

means defining a relatively large, primary oxygen supply chamber, including an oxygen inlet and an oxygen outlet;

means operably coupled with said oxygen outlet for delivery of oxygen from said primary chamber to a user;

means including an elongated tubular oxygen supply conduit operably coupled with said oxygen inlet; and means defining a relatively small, apertured, inflatable indicator element positioned within the confines of said primary chamber and operably coupled with said supply conduit for delivery of oxygen from said conduit into said element for inflation thereof, and for flow of such oxygen through said element aperture to the interior of said primary chamber.

2. The apparatus of claim 1, said indicator element comprising an elongated, tubular, inflatable body, said oxygen supply conduit being operatively coupled to one end of said body, said body having an aperture adjacent the opposed end thereof.

3. The apparatus of claim 2, said body being formed as an integral, one-piece, monolithic, molded body.

4. The apparatus of claim 1, said primary oxygen supply chamber comprising a pair of peripherally sealed sheets defining a relatively large volume when filled with oxygen.

5. The apparatus of claim 1, said primary chamber having an inflated volume at least ten times greater than the inflated volume of said element.

6. The apparatus of claim 1, including a reinforcing string secured to said oxygen supply conduit, extending out of said element aperture and through said primary chamber and oxygen outlet, and operably coupled with said oxygen delivery means.

7. The apparatus of claim 1, said supply conduit extending through said primary chamber oxygen inlet and into the confines of said indicator element.

8. The apparatus of claim 1, said oxygen delivery means comprising a mask adapted to be worn over the nose and mouth of a user.

9. The apparatus of claim 1, said conduit extending into the confines of said primary chamber, said element being secured to said element within said primary chamber, whereby said element is wholly located within the confines of said primary chamber.

10. The apparatus of claim 1, said indicator element having at least one line of weakness therein operable to open and vent oxygen from the element to the primary chamber, in the event of overpressurization of the element.

* * * * *